United States Patent [19]

Chamberlin

[11] Patent Number: 4,964,649

[45] Date of Patent: Oct. 23, 1990

[54] SNOWBOARD BOOT BINDER ATTACHMENTS

[76] Inventor: Justin M. Chamberlin, Apartment 15G, 713 J Clyde Morris Blvd., Newport News, Va. 23601

[21] Appl. No.: 323,812

[22] Filed: Mar. 15, 1989

[51] Int. Cl.[5] ..... A63C 9/08

[52] U.S. Cl. ..... 280/618; 280/14.2

[58] Field of Search ..... 280/607, 617, 618, 14.2, 280/613

[56] References Cited

U.S. PATENT DOCUMENTS

| | | | |
|---|---|---|---|
| 2,955,300 | 10/1960 | Hedlund | 441/68 |
| 3,900,204 | 8/1975 | Weber | 280/607 |
| 4,221,394 | 9/1980 | Campbell | 280/14.2 |
| 4,403,785 | 9/1983 | Hottel | 280/607 X |
| 4,652,007 | 3/1987 | Dennis | 280/618 |
| 4,728,116 | 3/1988 | Hill | 280/618 |
| 4,741,550 | 5/1988 | Dennis | 280/618 |
| 4,792,155 | 12/1988 | Besnier | 280/607 |

*Primary Examiner*—Charles A. Marmor
*Assistant Examiner*—Michael Mar
*Attorney, Agent, or Firm*—Wallace J. Nelson

[57] ABSTRACT

This invention relates to a rider responsive boot binder attachment mechanism that enhances the maneuverability and responsiveness of a snowboard to rider movements. A pair of first plate members 15 are secured in spaced relationship to a snowboard, a pair of second plate members 20 are rotatably secured, one each, to the first pair of plate members and boot binder mechanism 14 attached to each of the second plate members at the desired angulation therewith. Elastomeric structure in the form of elongated spiral springs 24,26,28 and 30 are disposed between each connected first and second plate to limit relative rotation therebetween and to exert a force on the plates to effect return to an original preset position after the plates have been rotated relative to each other by rider applied torque action. Adjustment mechanism is provided in each boss and stop element disposed at each end of each spring to adjust the effective length of each spring and thereby regulate the initial compression or tension exerted by each spring. A ball bearing assembly facilitates relative rotation between plates 15 and 20.

13 Claims, 4 Drawing Sheets

SNOWBOARD BOOT BINDER ATTACHMENTS

FIELD OF THE INVENTION

This invention relates generally to snowboards and relates more particularly to snowboard boot binder attachments that permit enhanced maneuverability or responsiveness of the snowboard by the rider.

BACKGROUND OF THE INVENTION

Snowboarding is a fast growing sport and improvements in the equipment to promote safety and to enhance the maneuverability or responsiveness of the snowboard by the rider should be well received. Presently some snowboards are ridden with the rider using only straps to maintain boot contact with the board. Snowboards with various type bindings are available commercially from several sources including Burton Snowboards, Manchester Center, Vt. Some of the commercially available snowboards combine boot bindings and steel plates attached to, or in the form of, inserts laminated into the board with the capability of fixedly adjusting the relative angular stance desired for the feet relative to the board. This adjustment is accomplished by removing and repositioning the screw attachment of the bindings after "dialing" or rotating the bindings to the desired stance location. Additional changes in the stance or relative rotation of the feet to the board are possible only by removing the boots from the board or when the board is not in use.

Accordingly, it is an object of the present invention to provide a boot binder attachment mechanism that permits the rider to rotate his feet relative to the snowboard during a ride to thereby enhance the maneuverability or responsiveness of the snowboard by these actions of the rider.

It is another object of the present invention to provide a rotatable attachment for boot binders on snowboards that may be activated by action of the rider to provide additional torque to the board during a snowboard ride.

It is a further object of the present invention to provide a rotatable attachment for boot binders on snowboards that automatically returns to the original setting after being rotated by a rider during a snowboard ride.

A further object of the present invention is a boot attachment mechanism for snowboards that provides variable feet angulation capabilities during a snowboard ride.

An additional object of the present invention is a boot attachment mechanism for snowboards that promotes snowboard action and responsiveness to rider action.

Another object of the present invention is a rider responsive boot binder attachment mechanism that enhances torque and tweak board action.

The foregoing and additional objects are attained, according to one aspect of the present invention, by providing a pair of first plate members secured in spaced relationship to a snowboard, a pair of second plate members rotatably secured, one each, to the first pair of plate members, boot binder mechanism attached to each of the second plate members, and elastomeric structure disposed between each connected first and second plate to limit relative rotation therebetween and to exert a force on the plates to effect return to an original preset position after the plates have been rotated relative to each other by rider applied torque action.

BRIEF DESCRIPTION OF THE DRAWINGS

A more complete appreciation of the invention and many of the attendant advantages thereof will be better understood when considered in connection with the accompanying drawings wherein.

DETAILED DESCRIPTION OF THE INVENTION

Figure 1:
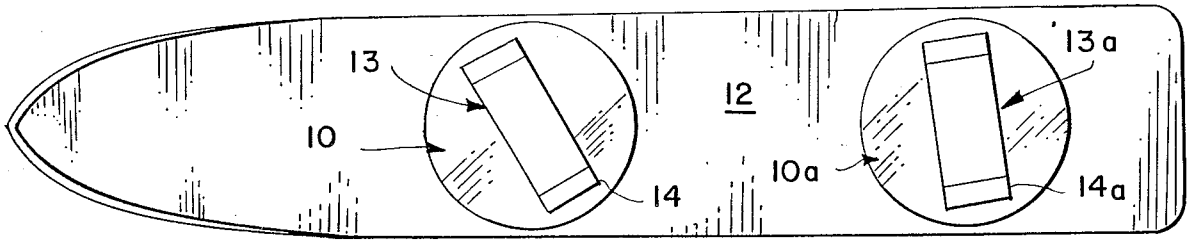
FIG. 1 is a top plan view of a preferred embodiment of the present invention.
Figure 2:
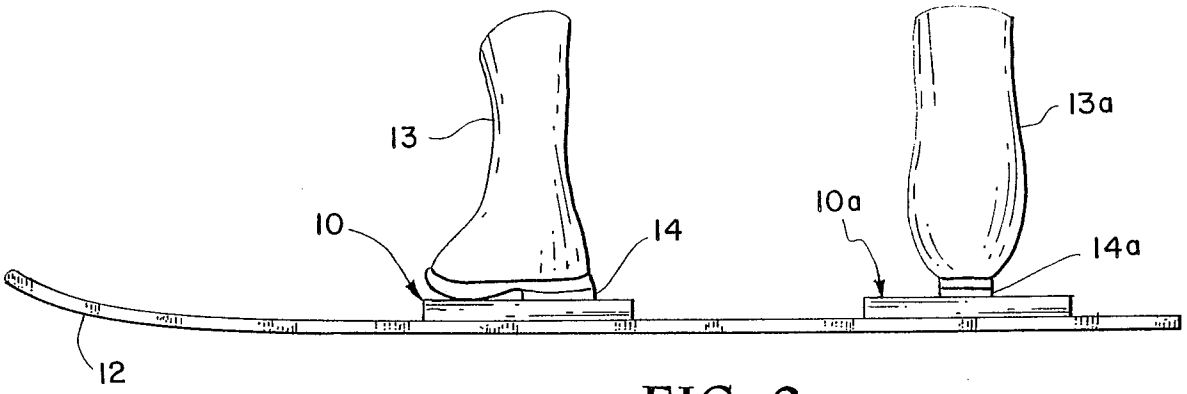
FIG. 2 is a side elevation of the invention as shown in FIG 1.

Referring now to the drawings and more particularly to FIGS. 1 and 2, the boot binder attachment mechanism of the present invention is illustrated and designated generally by reference numerals 10 and 10*a*. The boot binder attachment mechanisms 10 and 10*a* are identical for each boot or foot (13 and 13*a*) of a rider and only one will be described hereinafter in the interest of brevity. Boot binder attachment mechanism 10 is secured to a snowboard 12 with each mechanism 10 having connected thereto boot binders 14, 14*a* disposed at the desired angular relationship relative to snowboard 12 for attachment of a boot 13. Most snowboard riders prefer that the front foot be canted or angled approximately 45° toward the direction of travel with the aft foot disposed substantially perpendicular to or angled slightly toward the direction of travel, as shown in FIGS. 1 and 2. In the illustrated embodiments, the front foot is the rider's left foot but some riders prefer that the right foot be in front and the angular relationship and binder positioning would be reversed for this arrangement. The foot angulations are adjustable by selecting the attachment patterned holes provided in commercial boards 12 to the angle desired by a rider for a particular slope and/or snow condition.

Figure 3:
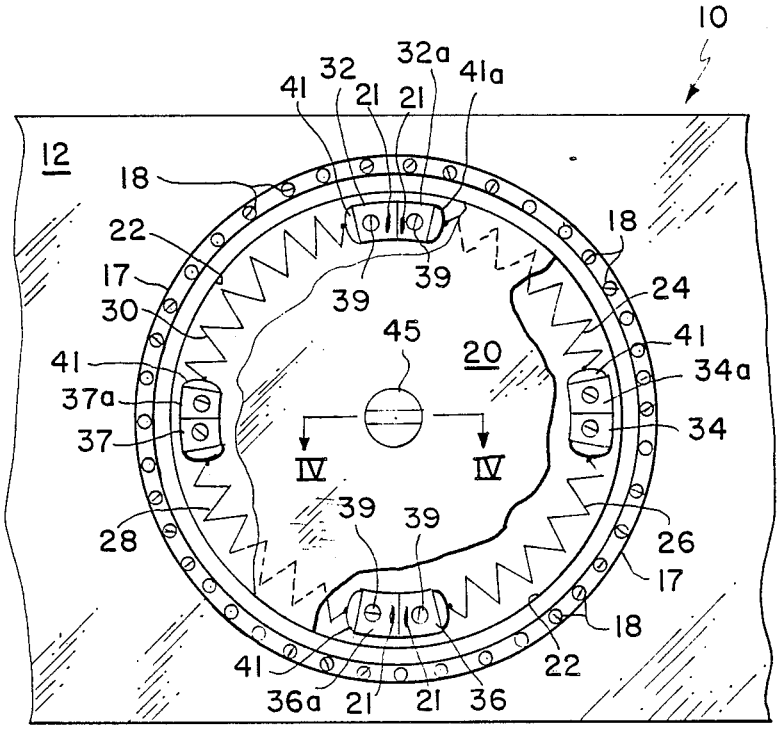
FIG. 3 is an enlarged top view of the boot binder attachment mechanism of the present invention with parts omitted and parts broken away.

Referring now more particularly to FIG. 3, a more detailed illustration of the board binder attachment mechanism 10 of the present invention will now be described. In this top view illustration, the actual boot support or binder 14 is removed and the attachments therefor to the board are illustrated. As shown therein, attachment mechanism 10 includes a first circular plate 15 fixedly secured to a snowboard 12 via an annular ring 17 and screws 18. Ring 17 is integral with and disposed around the periphery of, and on the same horizontal plane as, the bottom surface of first plate 15.

A second plate 20 is disposed over first plate 15 and retained in rotatable position thereon, as will be further explained hereinafter. An annular channel or groove 22 is formed in first plate 15 and disposed in spaced adjacency to the periphery thereof. A mating annular channel or groove 23 (FIG. 7) is provided in second plate 20 as will be further explained hereinafter. A plurality of coil springs are disposed within annular groove 22 as designated by reference numerals 24, 26, 28 and 30.

Two pair of adjustable boss elements 32, 32;*a* and 36, 36*a*; integrally depend from the annual channel 23 of second plate 20. The boss element pairs 32, 32*a* and 36, 36,*a* are spot welded to second plate 20 at points designated by reference numeral 21. As illustrated, each boss pair 32, 32*a* and 36, 36*a* matingly extend within arcurate channel 22 of first plate 15 at substantially 180° stations from each other. Each boss 32, 32*a* and 36, 36*a* is provided with an adjustment screw 39 that serves to expand or retract an extension 41 provided within each boss 32, 32*a*, and 36, 36*a*, as will be further explained hereinafter. One of these extensions 41 is shown in FIG. 3 extending slightly from boss 32.

Two pair of stop elements 34, 34*a* and 38, 38*a* are fixedly disposed in, and integrally extend upward from, annular channel 22 of first plate 15. Stop element pairs 34, 34*a* and 38, 38*a* are positioned at substantially 180° stations relative to each other or substantially 90° spaced from each depending boss pair 32, 32*a* and 36, 36*a*. Spot welding or other conventional attachment mechanism is employed to fix stop element pairs 34, 34*a* and 38, 38*a* within annular channel 22. An adjustment screw 39 is also provided for each member of stop elements 34, 34*a* and 38, 38*a* and serves to expand or retract an extension 42 provided within each stop element. One of these extension 42 is illustrated in FIG. 3 extending slightly from stop member 34. The expansion/retraction mechanism for extensions 41 and 42 is identical and will be further explained hereinafter.

Figure 4:
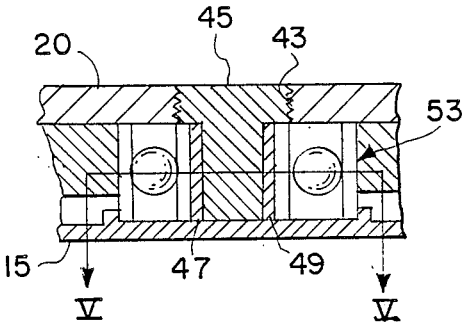
FIG. 4 is a sectional view of FIG. 3 taken along lines IV—IV of FIG. 3.
Figure 5:
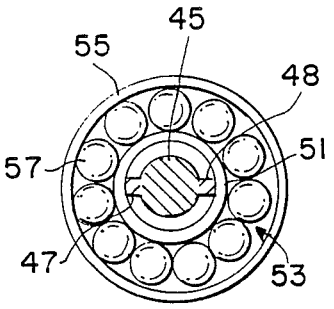
FIG. 5 is a sectional view of FIG. 4 taken along lines V—V of FIG. 4.

Referring now more particularly to FIGS. 4 and 5, second plate 20 is provided with a central threaded aperture 43 therein for threadingly receiving the externally threaded head of bolt 45 therein. The shank portion of bolt 45 is provided with a pair of diametrically opposed key projections 47, 49 extending substantially the length thereof. Key projections 47, 49 are received within a pair of keyway slots 48, 50 formed in annular journal 51 of a ball bearing 53. Ball bearing 51 is supported and retained at the center of first plate member 15 in a conventional manner and includes an annular raceway 55 spaced from annular journal 51. A plurality of steel balls 57 are rotatably disposed between and in contact with journal 51 and raceway 55 to assist in relative rotation therebetween.

Figure 6:
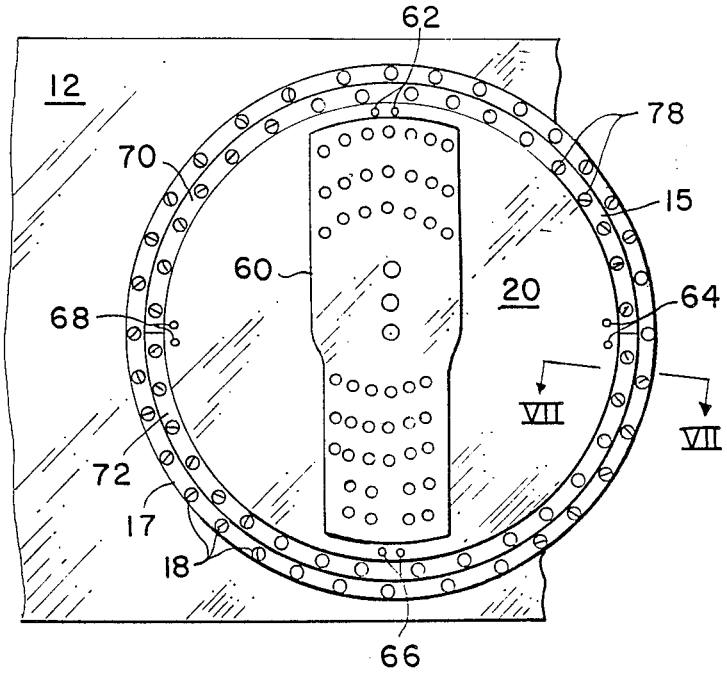
FIG. 6 is a top view of the assembled plates of the present invention illustrating the adjustable openings for attaching a boot support thereto.
Figure 7:
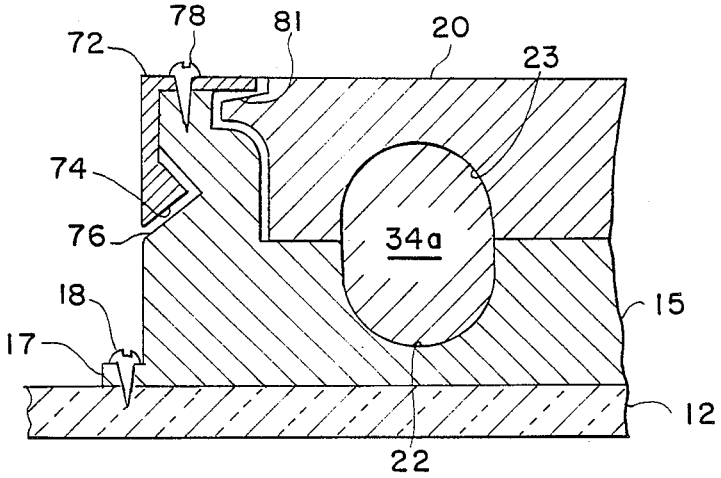
FIG. 7 is a sectional view taken along line VII—VII of FIG. 6 and illustrating the holding mechanism for assisting in retaining the plates in rotatable relationship.

Referring now more particularly to FIGS. 6 and 7, the top of assembled plates 15 and 20 is illustrated. As shown therein, an adjustment plate 60 is bolted or otherwise fixed to second plate 20. The multiple openings or holes shown in adjustment plate 60 are provided with internal threads to receive bolts for connecting a boot support or binder 14 for boot 13 (FIGS. 1 and 2). The location or position for binder 14 is linearly and angularly adjusted to that desired by selecting the attachment holes in adjustment plate 60 to receive the binder. As noted thereon, there are three linear adjustments provided by the three center holes. Three arcurate rows of holes at each end of adjustment plate 60 permit angular adjustment of the binder for any linear location selected to thereby rigidly attach the binder to adjustable plate 60 at the angulation desired. Adjustment plate 60 may be omitted and boot binder 14 directly attached to second plate 20, if so desired.

Paired openings 62 64, 66 and 68 are provided at 90° stations about the circumference of second plate 20 to permit access to individual adjustment screws 39 for respective depending bosses 32, 32*a* and 36, 36*a* and for stops 34, 34*a* and 38, 38*a*. Rotation of individual screws 39 causes expandable extensions 41, 42 on the respective depending bosses or stops to expand or contract, depending on the direction of screw rotation, to thereby individually increase or decrease the tension or compression on either end of springs 24, 26, 28 and 30. This expansion or contraction of extension 41 may be actuated through a rack and pinion system (FIGS. 8 and 9) as will be further described hereinafter.

A pair of semi-circular retainer rings 70, 72 are positioned together about the edges of first plate 15 and second plate 20 to retain the plates in relative rotational adjacency. As more clearly shown in FIG. 7, retainer ring 72 has an in-turned arcurate or semi-circular wedge terminus 74 provided at one end thereof and received by an annular groove 76 disposed about the circumference of lower plate 15. Wedge terminus 74 merges with a vertical section of a semi-circular ring that extends into and terminates in an in-turned semi-circular ring portion 78, essentially parallel with wedge terminus 74, and overlapping an edge of both first plate 15 and second plate 20. A plurality of screws 80 serve to connect semi-circular retainer rings 70 and 72 to first plate 15 while maintaining an annular section 81 of second plate 20 rotationally received beneath in-turned segment portion 78 of semi circular ring 72 and a like in-turned segment of semi-circular ring 70.

Figure 8:
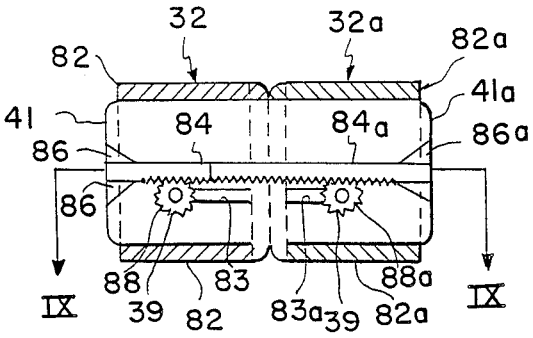
FIG. 8 is a top view of one boss pair with parts in section and parts broken away to show the interior thereof.
Figure 9:
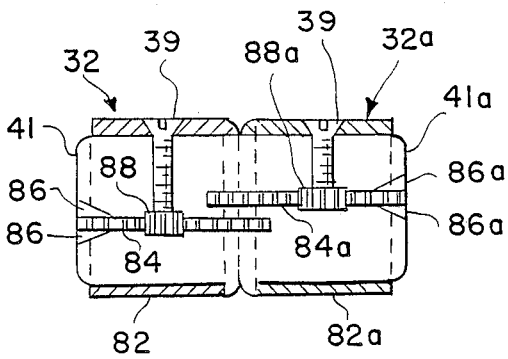
FIG. 9 is a sectional view taken along line IX—IX of the boss pair illustrated in FIG. 6.

Referring now more particularly to FIGS. 8 and 9, the details of one depending boss pair 32, 32*a* will now be described. It is to be understood that the other boss pair 36, 36*a* and each stop pair 34, 34*a* and 38, 38*a* are of identical construction to that of the boss pair 32, 32*a* shown in FIGS. 8 and 9. As shown, boss pair 32, 32*a* includes back-to-back or abutting identical tubular shells 82, 82*a*. Expandable extensions 41, 41*a* are telescopically positioned within the outer end, respectively, of shells 82, 82*a*. Each expandable extension 41, 41*a* is provided with a slot in the circumference thereof to permit sliding relationship of the extension with screws 39. These slots are shown in dotted line in FIG. 8 and designated, respectively, by reference numerals 83, 83*a*. A rack and pinion mechanism actuated by rotation of screws 39 controls expansion and retraction of extensions 41, 41*a* relative to shells 82, 82*a*. As shown, racks 84, 84*a*, for respective bosses 32, 32*a*, are vertically offset (FIG. 9) from each other to permit receipt of one rack end within the adjacent shell when extensions 41, 41*a* are fully retracted within shells 82, 82*a*. The other end of each rack is rigidly secured via braces 86, 86*a* to the respective extension 41, 41*a*. Drive pinions 88, 88*a* are integrally connected for rotation with screws 39 and serve to drive respective racks 84, 84*a* upon rotation thereof. Shells 82, 82*a* and extensions 41, 41*a* are formed of suitable lightweight stainless steel, or similar material of adequate strength to permit the spot weld or other binding attachment and to withstand the pressure from the coil springs bearing against the extensions. The frictional force necessary to rotate pinions 88 and 88*a* also must be in excess of the pressure exerted by the coil springs bearing against respective extensions 41, 41*a* during all degrees of compression or tension for adequate operation of the system.

ASSEMBLY AND OPERATION

As discussed hereinbefore, the present invention may be retro-fitted onto existing snowboards or may be factory installed. When installed at the factory, projections or ears 17 on first plate 15 may be extended, or maintained at the same length, and laminated into the board as it is constructed. In this situation, screws 18 may be omitted or reduced in number. When retro fitting the present invention onto existing snowboards first plate 15 would be installed as described hereinbefore. Springs 24, 26, 28 and 30 are positioned in annular groove 22 in contact with spot weld attached paired stops 34, 34*a* and 38, 38*a*. Second plate 20 is then placed over first plate 15, after the paired depending bosses 32, 32*a*; and 36, 36*a*, are spot welded in channel 23 such that they bear against the ends of springs 24 and 26, as illustrated in FIG. 3. These springs may be installed in normal or unflexed condition, under compression, or under tension, as desired. Spring 26 in FIG. 3 is shown attached to stop 34*a* and boss 36 at points designated, respectively, by reference numerals 35 and 35*a*, while spring 28 is attached to depending boss 36*a* and stop 38 at points designated, respectively, by reference numeral 37 and 37*a*. Thus, springs 26 and 28 may be installed at normal unflex condition or, by adjusting the attached bosses, under tension.

Spring 24 rests against depending boss 32*a* and stop 34 while spring 30 rests against depending boss 32 and stop 38*a*. Therefore, springs 24 and 30, as illustrated, may be installed in a normal unflex condition or under compression. Obviously, each of springs 24 and 30 may be connected to the boss and stop disposed at the respective ends thereof and springs 26 and 28 could just as well be installed as bearing against, in lieu of being connected to, the depending boss and stop disposed at each end thereof, if so desired.

After installation of springs 24, 26, 28 and 30 and positioning of second plate 20 over first plate 15, key extensions of bolt 45 are inserted into the keyways 48, 50 of journal 51 of ball bearing 53 and bolt 45 tightened via the threaded head thereof engaging threaded opening 43. The keyed journal 51 rotates with bolt 45 as tightened. Semi-circular retainer rings 70, 71 are then positioned around first plate 15, in groove 76 thereon, and over the outer edge 81 of second plate 20. Screws 78 are then installed through the in-turned ring portion of retainer rings 70, 71 for fixed attachment thereof to first plate 15.

A suitable allen wrench or screwdriver is then inserted into each one of the paired openings 62, 64, 66 and 68 to turn adjustment screws 39 for adjusting or fine tuning the adjustment of the compression or tension on each of springs 24, 26, 28 and 30. Adjustment plate 60 is then installed over second plate 20 by conventional screws (not shown) and the boot binder 14 connected to adjustment plate 60 at the desired angulation and linear location, as selected from the arcurate and linear hole arrangement in adjustment plate 60.

After installation, and during a snowboard ride, when the rider desires to apply extra torque to his board, he twists his body, along with one or both feet, to cause the boot binder and connected second plate to rotate relative to the first plate. This relative rotational movement applies a torque to the board and generates enhanced maneuverability and responsiveness of the board. The relative rotation between the plates is assisted by the bolt 45 and ball bearing assembly 53 connection. When the rider relaxes the twisting force being exerted, the spring or springs in first plate 15 will "push", or exert a force on the second plate, to attempt spring recovery back to the position or state of flex prior to the rider applied torque. This spring action causes the board to reverse the rider induced rotation and tend to rotate back to the original position relative to the rider since the board offers less resistance than that of the rider's weight. This board rotation promotes greater board action and adds to the thrill of the ride. With practice, the rider will determine how much spring action is needed for a particular slope or slope condition and, by properly adjusting the feet angulation and spring flex prior to a run, will be able to predict and better control the board action.

It is thus seen that the present invention adds new dimensions to the maneuverability and responsiveness of snowboards and will greatly increase the thrill and interest in snowboarding. The boot binder attachments described herein are directed to the use thereof by both feet of the rider and are of identical construction with the only difference being the initial angular setting for each boot.

The specific embodiment of the present invention described herein is intended to be exemplary only and is not considered to be exhaustive. Also, no specific materials or dimensions have been described for constructing the individual components of the present invention. Normally, plates 15, 20 and 60 would be constructed of durable lightweight stainless steel. Semi-circular retainer rings may also be constructed of similar stainless steel but may also be constructed of Teflon or similar durable plastics material. There are obviously numerous variations and modifications of the present invention that will be readily apparent to those skilled in the art. For example, the operation of the present invention is not dependent upon the illustrated four springs and one, two, three, or more than the four illustrated, may be employed without departing from the spirit and scope of the invention. When employing less than four springs in the illustrated embodiment, a collapsible, lightweight and non-resilient arcurate "slug" or plug may be substituted for the omitted spring(s), or the space may be left empty. Also, the springs employed need not be confined to spiral springs arranged in a circular or arcurate arrangement. Other elastomeric components and/or other type springs may be employed and disposed in angular arrangements without departing from the spirit or scope of the present invention. Other tension or compression adjustments for the springs employed, in lieu of, or in addition to, the adjustable depending bosses and stops shown and described herein may also be employed. Also, the rotatable attachment for first and second plates 15 and 20 need not be confined to the semi-circular retainer rings described and the ball bearing assembly 53 may be of a different construction than that specifically described and illustrated herein.

These and other variations and modifications of the present invention will be readily apparent to those skilled in the art in the light of the above teachings. It is therefore to be understood that, within the scope of the appended claims, the invention may practiced other than as specifically described herein.

What is claimed as new and desired to be secured by Letters Patent of the United States is:

1. Apparatus responsive to rider action for enhancing the maneuverability of a snowboard comprising:

a pair of first circular plate members adapted to be secured in a fixed spaced relationship directly to a snowboard, a pair of second plate members rotatably secured, one each, to said pair of first circular plates to thereby permit relative rotation between said first and said second plates, boot binder means secured to each of said second plates for releasably engaging the boots of a snowboard rider, each of said pair of second plate members being responsive to rider induced action to rotate relative to each of said first circular plate members, at least one elastomer element disposed between each connected first and second plate to limit relative rotation therebetween and to exert a force on said plates to effect return to an original preset position after said plates are rotated relative to each other, adjustment means attached to the top surface of each of said pair of second plates to permit separate fixed angular adjustment settings for said boot binder means on each member of said pair of second plates, said at least one elastomeric element comprising at least a pair of elongated coil springs, each member of said first pair of plates having an annular channel therein for supporting each member of said pair of coil springs, stop means disposed within said annular channel and abutting an end of each of said pair of elongated coil springs, depending boss means attached to and extending from each member of said second pair of plates and disposed within said channel, said depending boss means abutting an end of each said pair of elongated coil springs opposite to the end thereof abutting said stop means, said depending boss means being rotatable with said second plate member and serving to compress at least one member of said pair of coil springs toward said stop means during rotation thereof.

2. Apparatus responsive to rider action for enhancing the maneuverability of a snowboard comprising:

a pair of first circular plate members adapted to be secured in fixed spaced relationship directly to a snowboard, a pair of second plate members rotatably secured, one each, to said pair of first circular plates to thereby permit relative rotation between said first and said second plates, boot binder means secured to each of said second plates for releasably engaging the boots of a snowboard rider, each of said pair of second plate members being responsive to rider induced action to rotate relative to each of said first circular plate members, at least one elastomer element disposed between each connected first and second plate to limit relative rotation therebetween and to exert a force on said plates to effect return to an original preset position after said plates are rotated relative to each other, adjustment means attached to the top surface of each of said pair of second plates to permit separate fixed angular adjustment settings for said boot binder means on each member of said pair of second plates, said at least one elastomeric element comprising at least a pair of elongated coil springs, each member of said pair of coil springs being disposed within an arcurate channel formed in each of said first plates, each of said elongated coil springs having one end thereof connected to a stop member secured within said arcurate channel and having the other end thereof connected to a boss extending within said arcurate channel, each said boss being secured to and rotatable with said second plate member, whereby, each said boss is rotated by rotation of said second plate member, and at least one member of said pair of coil springs will be expanded to increase the tension thereon.

3. Apparatus responsive to rider action for enhancing the maneuverability of a snowboard comprising:

a pair of first plate members adapted to be secured in fixed spaced relationship to a snowboard, a pair of second plate members rotatably secured, one each, to said pair of first plates to thereby permit relative rotation between said first and said second plates, boot binder means secured to each of said second plates for releasably engaging the boots of a snowboard rider, each of said pair of second plate members being responsive to rider induced action to rotate relative to each of said first plate members, means disposed between each connected first and second plate to limit relative rotation therebetween and to exert a force on said plates to effect return to an original preset position after said plates are rotated relative to each other, said means disposed between each connected first and second plates to limit relative rotation therebetween and to exert a force on said plates to effect their return to an original preset position after said plates are rotated relative to each other including at least one elastomeric element, said at least one elastomeric element comprising two pair of elongated coil springs, an arcurate circumferential channel disposed within and adjacent the circumferential boundary of each member of each said first pair of plates, means disposed within said arcurate circumferential channel dividing said channel into four separate arcurate channels, said four arcurate channels being paired and including two pair of stop members disposed in facing relationship and substantially 180° apart within said arcurate circumferential channel, two pair of boss elements disposed in facing relationship and substantially 180° apart, said boss elements and said stop members being substantially 90° from each other, said two pair of boss elements attached to and depending from each member of said second pair of plates, said stop elements being attached to said first plate, said two pair of coil springs being disposed one each in said four separate arcurate channels and having one end thereof in contact with one of said boss elements and the other end thereof in contact with one of said stop elements, an adjustment mechanism disposed within each member of each said pair of depending boss elements and within each member of said stop members, said adjustment mechanism serving to adjust the effective length of the said elongated springs disposed in said arcurate channels.

4. The apparatus of claim 3 wherein each member of said two pair of coil springs is disposed in abutting contact with one of said stop elements and one of said boss elements and said adjustment mechanism serves to compress said coil spring when moved in a first direction and to permit said coil spring to expand when moved in a second direction.

5. The apparatus of claim 3 wherein each member of said two pair of coil springs is connected to one of said bosses and to one of said stop elements and said adjustment mechanism serves to change the tension of said coil spring.

6. Apparatus for enhancing the maneuverability of a snowboard during a snowboard ride comprising:

a snowboard, a boot binder attachment for each boot of a snowboard rider, each said boot binder attachment including a first plate member secured to said snowboard, a second plate member rotatably secured to said first plate for relative rotational movement therewith, boot binder means secured to said second plate for bindingly engaging a boot of a rider, means disposed between and engaging said first and said second plates to limit relative rotation therebetween and to exert a force on said plates to effect return to an original preset position after said plates are rotated relative to each other, said means disposed between said engaging said first and said second plates to limit relative rotation therebetween including at least one elastomeric element, said elastomeric element comprising an elongated spiral spring, an arcurate passageway formed in said first plate, said elongated spiral spring being disposed in said passageway and having one end thereof engaging a boss, said boss extending into said passageway and being attached to and rotatable with said second plate, said spring having the opposite end thereof engaging a stop element, said stop element being disposed in said passageway and being secured to said first plate.

7. The apparatus of claim 6 including adjustment means attached to a surface of said second plate to permit fixed angular adjustment settings for said boot binder means relative to said snowboard.

8. The apparatus of claim 6 including a ball bearing assembly centrally disposed between said first and said second plate members, said ball bearing assembly including an annular raceway attached to said first plate member, an annular journal disposed within and in spaced relationship with said annular raceway, a plurality of ball bearings disposed between and in contacting relationship with said annular raceway and said annular journal, a bolt member carried by said second plate member and extending into said annular journal of said ball bearing assembly, and means securing said bolt member in said annular journal to cause rotation of said journal relative to said annular raceway when said bolt member is rotated.

9. The apparatus of claim 8 wherein said bolt member has a head and a shank portion and said head portion is threadingly secured to said second plate member and said shank portion extends into said journal, said shank and said journal being provided with mating key connections therebetween for preventing relative rotation therebetween.

10. The apparatus of claim 6 wherein each said boss and each said stop element includes adjustment structure for selectively changing the effective length of said elongated spiral spring.

11. The apparatus of claim 10 wherein said boss adjustment structure includes a first sleeve member, a second sleeve member telescopically positioned within said first sleeve member, and means for inducing telescopic of said second sleeve member relative to said first sleeve member.

12. The apparatus of claim 11 wherein said means for inducing telescopic movement of said second sleeve member relative to said first sleeve member includes a rack member secured to and moveable with said second sleeve member, a pinion member supported by said first sleeve member and engaging said rack member and means for rotating said pinion member to determine the relative position of said first and said second sleeve members.

13. The apparatus of claim 12 wherein said means for rotating said pinion member comprises a screw member, said screw member having a head portion facing said second plate member and opening means disposed within said second plate member to permit engagement and rotation of said screw member.

* * * * *